US011161263B2

(12) United States Patent
Parmele et al.

(10) Patent No.: US 11,161,263 B2
(45) Date of Patent: Nov. 2, 2021

(54) RAZOR CARTRIDGE CONNECTION AND HANDLE

(71) Applicant: Harry's, Inc., New York, NY (US)

(72) Inventors: James Robert Parmele, Brooklyn, NY (US); Justin Garrett Riley, Quincy, MA (US)

(73) Assignee: Harry's, Inc., New York, NY (US)

( * ) Notice: Subject to any disclaimer, the term of this patent is extended or adjusted under 35 U.S.C. 154(b) by 103 days.

(21) Appl. No.: 16/548,393

(22) Filed: Aug. 22, 2019

(65) Prior Publication Data

US 2021/0053241 A1 Feb. 25, 2021

(51) Int. Cl.
*B26B 21/52* (2006.01)
*B26B 21/22* (2006.01)

(52) U.S. Cl.
CPC ..... *B26B 21/521* (2013.01); *B26B 21/528* (2013.01); *B26B 21/225* (2013.01)

(58) Field of Classification Search
CPC ... B26B 21/521; B26B 21/225; B26B 21/528; B26B 21/4062; B26B 21/38; B26B 21/526; B26B 21/443; B29C 66/54; B29C 65/08; B29L 2031/7186
USPC ..... 30/526–536, 41.7, 34.05, 35, 47–51
See application file for complete search history.

(56) References Cited

U.S. PATENT DOCUMENTS 4,253,235 A * 3/1981 Jacobson ..... B26B 21/521 30/47
4,283,850 A 8/1981 Douglass et al.
4,428,116 A * 1/1984 Chen ..... B26B 21/521 30/47
4,492,025 A * 1/1985 Jacobson ..... B26B 21/227 30/530
4,514,904 A * 5/1985 Bond ..... B26B 21/225 30/47
4,658,505 A 4/1987 Williams
4,739,553 A 4/1988 Lazarchik
(Continued)

FOREIGN PATENT DOCUMENTS

EP 1671761 B1 3/2008
GB 2078589 A 1/1982
(Continued)

OTHER PUBLICATIONS

Calabrese, Nunziante, "Extended European Search Report on European Patent Application No. EP20192019.6," European Patent Office, dated Dec. 14, 2021.

*Primary Examiner* — Ghassem Alie
(74) *Attorney, Agent, or Firm* — Florek & Endres PLLC

(57) ABSTRACT

A connector for a razor handle having first and second arms, each arm including a fixed end, a terminal end where the terminal end has a razor cartridge engagement member movable from a capture position to a release position, a first surface and an opposed second surface. An activator having an activation element acts on each arm for moving the arms toward each other into the release position when the activator is activated, and a biasing member that acts on each arm for biasing the arms outwardly into the capture position. The activation element acts on the arms between the fixed end and the terminal end on the first surface of the arms and the biasing member acts on the arms between the fixed end and the terminal end on the second surface of the arms.

19 Claims, 6 Drawing Sheets

(56) References Cited

U.S. PATENT DOCUMENTS

| | | | | |
|---|---|---|---|---|
| 4,797,998 | A * | 1/1989 | Motta | B26B 21/225 30/530 |
| 5,016,352 | A * | 5/1991 | Metcalf | B26B 21/225 30/47 |
| 5,182,858 | A | 2/1993 | Chen | |
| 5,787,856 | A | 8/1998 | Dunton | |
| 5,953,824 | A * | 9/1999 | Ferraro | B26B 21/225 30/527 |
| 6,421,925 | B1 | 7/2002 | Wonderley | |
| 6,854,188 | B1 | 2/2005 | Wonderley | |
| 7,685,720 | B2 | 3/2010 | Efthimiadis et al. | |
| 7,690,122 | B2 | 4/2010 | Worrick, III et al. | |
| 8,732,965 | B2 | 5/2014 | Efthimiadis et al. | |
| 9,193,077 | B2 | 11/2015 | Worrick | |
| 9,522,472 | B2 | 12/2016 | Leicht et al. | |
| 10,639,808 | B2 * | 5/2020 | Ren | B26B 21/225 |
| 2007/0214662 | A1 * | 9/2007 | Efthimiadis | B26B 21/521 30/527 |
| 2017/0087733 | A1 | 3/2017 | Metcalf et al. | |
| 2017/0334083 | A1 * | 11/2017 | Gratsias | B26B 21/4018 |

FOREIGN PATENT DOCUMENTS

| | | | |
|---|---|---|---|
| GB | 2086790 | A | 5/1982 |
| GB | 2172236 | A | 9/1986 |

* cited by examiner

RAZOR CARTRIDGE CONNECTION AND HANDLE

FIELD OF THE INVENTION

The present invention relates to the field of shaving razors and more particularly a connection for a razor cartridge for razor handles.

BACKGROUND OF THE INVENTION

Razors for shaving have developed from disposable one-piece razors, having a unitary handle and shaving surface, to a handle and razor cartridge system, where the cutting blades are positioned on a razor cartridge that is removably attached to a handle. The removable razor cartridges can be repeatedly replaced on a single handle, so that the handle can be used through hundreds, if not thousands, of razor cartridge replacements. This has allowed manufacturers to not only offer more substantial handles to the consumer, but also to offer better razor cartridges at lower costs.

The use of replaceable razor cartridges has resulted in the need for connectors that allow the razor cartridge to be releasably connected to the handle while providing a secure hold of the razor cartridge on the razor handle during shaving.

An example of a connector for attachment of a replaceable razor cartridge to a razor handle is a connection post at the end of the handle is shown in U.S. Pat. No. 9,522,472, where a cartridge having an aperture for receiving the post is friction fit onto the post. Another example that uses friction fit comprises a lateral track at the end of the handle that is received by a channel on the underside of a razor cartridge, as shown in U.S. Pat. No. 4,283,850.

Alternative examples of connectors include the use of mechanical catch features, where the razor cartridge and connector have cooperating features that hold the cartridge on the handle. These connectors generally include a button or other activator that moves at least one of the cooperating features out of a restricted space to release the other cooperating feature. Some connectors that use catches are shown in U.S. Pat. Nos. 5,787,586, 7,690,122 and 9,193,077.

The connector for removably retaining a razor cartridge on a razor handle can perform additional features, depending on the desired functionality.

In a basic configuration, the connection between the razor cartridge and the connector is fixed so that the razor cartridge does not move on the connector. When using fixed connectors, the cutting blades are either fixed in relation to the razor handle or the razor cartridge has a pivot element located between a cartridge connecting member and a blade member on the cartridge itself, allowing the blade member to rotate in relation to the cartridge connecting member. Examples of fixed connectors are found in U.S. Pat. Nos. 5,787,586, 7,690,122 and 9,193,077, cited above.

In an alternative configuration, the connector itself provides a pivot between the blade member of the razor cartridge and the handle. Generally, this connector utilizes an arced or circular surface on at least one of the razor cartridge or the connector that cooperates with cooperating structure on the other component, allowing the razor cartridge to pivot on the connector. This configuration reduces the requirements of the razor cartridge, eliminating the pivot existing entirely on the razor cartridge itself, potentially simplifying manufacture and lowering the cost of the razor cartridge. Examples of pivot connectors for use with cooperating razor cartridges are found in U.S. Pat. Nos. 4,658,505, 6,421,925, 6,854,188 and 8,732,965.

Another example of a connector that provides a pivot between the blade member and the handle is shown in U.S. Pat. No. 7,685,720. However, this example requires the use of two push buttons, one on each side of the handle, to release the razor cartridge, and a plastic retainer on a spring to interact with a plastic receiver on the arms to hold the arms in an open position until a new razor cartridge is attached. This structure, however, requires tight tolerances during manufacture to ensure the capture of the receiver by the retainer and creates a plastic on plastic connection that is prone to failure.

The prior art, therefore, is limited with respect to pivot connectors for the pivotal connection of a razor cartridge to a handle that can be easily manufactured and do not require two-finger release. In keeping, the present invention is directed to an improved razor cartridge connector, including a simple, easily manufactured, secure connector for use with a razor handle to provide pivotable connection of a razor cartridge.

SUMMARY OF THE INVENTION

The present invention is directed to a connector for connecting a replaceable razor cartridge to a razor handle, as well as a razor handle with the connector. The connector comprises first and second arms, each arm comprising a fixed end and a terminal end, wherein the terminal end comprises a razor cartridge engagement member movable from a capture position to a release position, and opposed first and second surfaces. An activator comprising an activation element or pusher which acts upon the arms for moving the arms toward each other into the release position when the activator is activated, and a biasing member for biasing the arms outwardly into the capture position. The activation element acts upon the arms between the fixed end and the terminal end on the first surface of the arms and a biasing member acts upon the arms between the fixed end and the terminal end on the second surface of the arms and the.

It is understood that when describing that the activation element acts on the first surface of the arms and the biasing member "acts on" the second surface of the arms it means that the activation element and biasing member can contact the first and second surfaces of the arms directly or through one or more intermediate parts.

The connector is preferably set in a housing comprising housing panels, where the fixed end of each of the arms are located in the housing and the terminal ends of the arms extend to the exterior of the housing to capture the razor cartridge. The fixed end of each of the arms are preferably fixed to an interior of a housing panel with the activator fixed on the exterior of a housing panel, such that the activation element passes through one or more elongated apertures into the housing to engage the arms, although the fixed ends of the arms and the activator do not need to be fixed to the same housing panel. Side walls or side elements on at least one of the housing panels of the housing preferably provide stops that limit the outward travel of the connector arms.

The arms of the connector can be formed as a unitary member, where the arms are coupled in the area of the fixed end of each arm. In a preferred embodiment, the fixed ends of each arm are coupled by an attachment element, which preferably engages a cooperating capture element on the housing panel to attach the unitary member to the housing panel. For example, the attachment element can be an attachment opening on the unitary member that receives a mating capture boss on the housing panel, thereby attaching the unitary member to the housing panel and fixing the fixed ends of the arms. Conversely, the arms of a unitary member can be coupled in the area of an attachment boss that is received in a capture opening on the housing panel to attach the unitary member to the housing panel, thereby fixing the fixed ends of the arms.

Alternatively, the arms can be formed separately and the fixed end of each arm fixed independently within the housing, preferably to separate bosses on a housing panel. Although the fixed ends of the arms may be set in a fixed positon on the housing panel, they may be rotatably fixed to the housing panel. In such an embodiment, cooperating openings and bosses on the arms and housing panel not only fix the arms on the housing panel but also permit the arms to rotate when the activator is activated.

The connector is intended for use with a razor cartridge that pivots in a direction perpendicular to the elongated axis of the handle. In a preferred embodiment, the razor handle includes a biasing element for biasing the razor cartridge toward a rest position. Although both the biasing member and biasing element can be any structure that exerts a biasing force, such as coil springs, piano springs, leaf springs, or the like, including combinations, it is intended that the biasing element operates independently of the biasing member of the connector and can be the same or different biasing structure. The preferred biasing element comprises a spring loaded plunger that contacts a cam surface on the razor cartridge, the plunger being biased outwardly from the handle by the spring to bias the razor cartridge into the rest position, as is well known in the art.

The razor cartridge connection element at the terminal end of each of the arms preferably comprises an outward extension that fits within a receiver on the razor cartridge to secure the razor cartridge on the connection elements of the arms. In a preferred embodiment, at least one of the connection element and the razor cartridge comprises a rotational surface permitting the razor cartridge to pivot on the connector. It is also preferred that the connection element on at least one of the arms and on the cooperating receiver of the razor cartridge comprises a cooperating key and keyway to ensure that the razor cartridge is attached to the connector on the correct side.

During the preferred method of manufacture of the connector, the activator is snap-fit onto an exterior wall of a housing panel, preferably with barbed arms that pass through elongated apertures on the housing panel, so that the activator is slidingly locked onto the exterior of the housing panel. The activation element passes through one or more elongated openings, into the interior of the housing, and slides within the housing when the activator slides along the exterior of the housing panel. The fixed ends of the arms are then fixed on a housing panel, with the terminal ends of the arms extending beyond the housing panel. The biasing member for biasing the arms in a capture position is installed between the second surfaces of the arms. The plunger and biasing element are then affixed to a housing panel and the housing panels are coupled to substantially enclose the housing.

When a razor cartridge is to be released, the activator is slid so that the activation element engages first surfaces of the arms, forcing the arms inwardly. When the activator is released, the biasing force on the second surfaces of the arms pushes against the activation element to move the activator back to the rest position.

BRIEF DESCRIPTION OF THE DRAWINGS

The present invention will be better understood when considered in view of the attached drawings, in which like reference characters indicate like parts. The drawings, however, are presented merely to illustrate the preferred embodiment of the invention without limiting the invention in any manner whatsoever.

DETAILED DESCRIPTION OF THE PREFERRED EMBODIMENT

Figure 1:
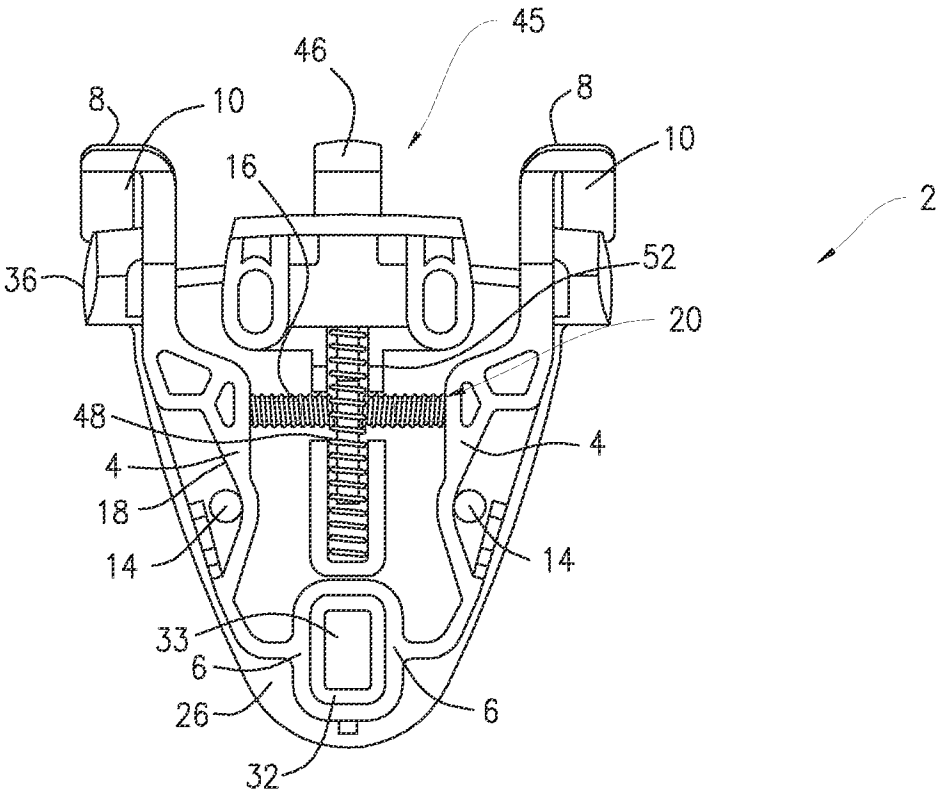
FIG. 1 is a plan view of a preferred razor cartridge connector according to the present invention, including a razor cartridge biasing element.

A preferred embodiment of the razor cartridge connector 2 of the present invention shown in FIGS. 1-3 and 4 comprises first and second arms 4, each arm 4 comprising a fixed end 6 and a terminal end 8 wherein the terminal end 8 comprises a razor cartridge engagement member 10 movable from a capture position to a release position, and opposed first and second surfaces 18 and 20. In the preferred embodiment, first surfaces 18 correspond to the surfaces of the arms 4 that face away from each other at the terminal ends 8 and second surfaces 20 correspond to the surfaces of the arms 4 that face each other at the terminal ends 8.

An activator 12 comprises an activation element 14 associated with the first surface 18 of each arm 4, for moving the arms 4 toward each other into the release position when the activator 12 is activated. A biasing member 16, for biasing the arms 4 outwardly into the capture position, acts on the second surface 20 of each arm 4 to maintain the arms 4 in the capture position. The activation element 14 engages the first surface 18 of each arm 4 between the fixed end 6 and the terminal end 8, and the biasing member 16 engages the second surface 20 of each arm 4 between the fixed end 6 and the terminal end 8.

Figure 2:
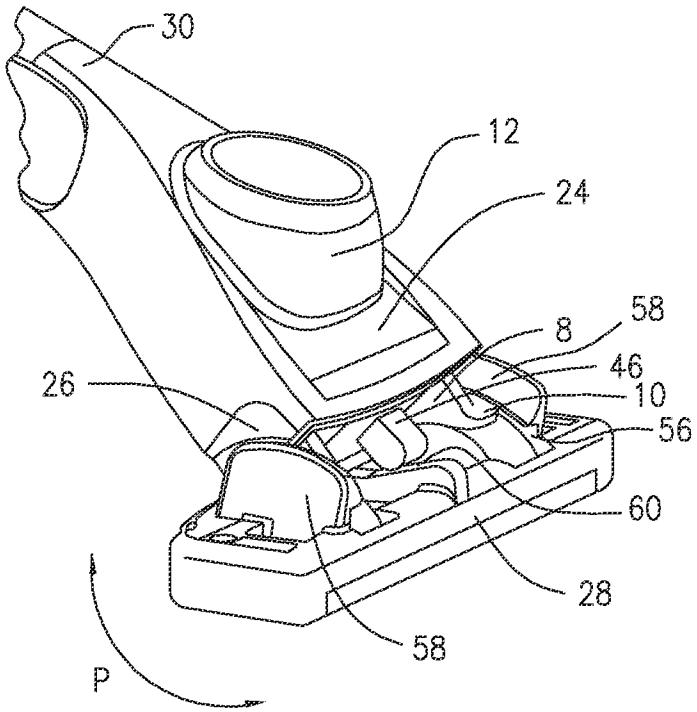
FIG. 2 is a perspective view of a razor cartridge held on the connector according to the present invention.

As shown in FIG. 2, the connector 2 of a preferred embodiment is set in a housing 22 comprising a main housing panel 24, which is preferably integrated with a razor handle 30, and a cover housing panel 26 that is fit onto the main housing panel 24. The fixed end 6 of each arm 4 is located within the housing 22, fixing the arms 4 to a point within the housing 22, and the terminal end 8 of each arm 4 extends to the exterior of the housing 22, to capture the razor cartridge 28.

Figure 3:
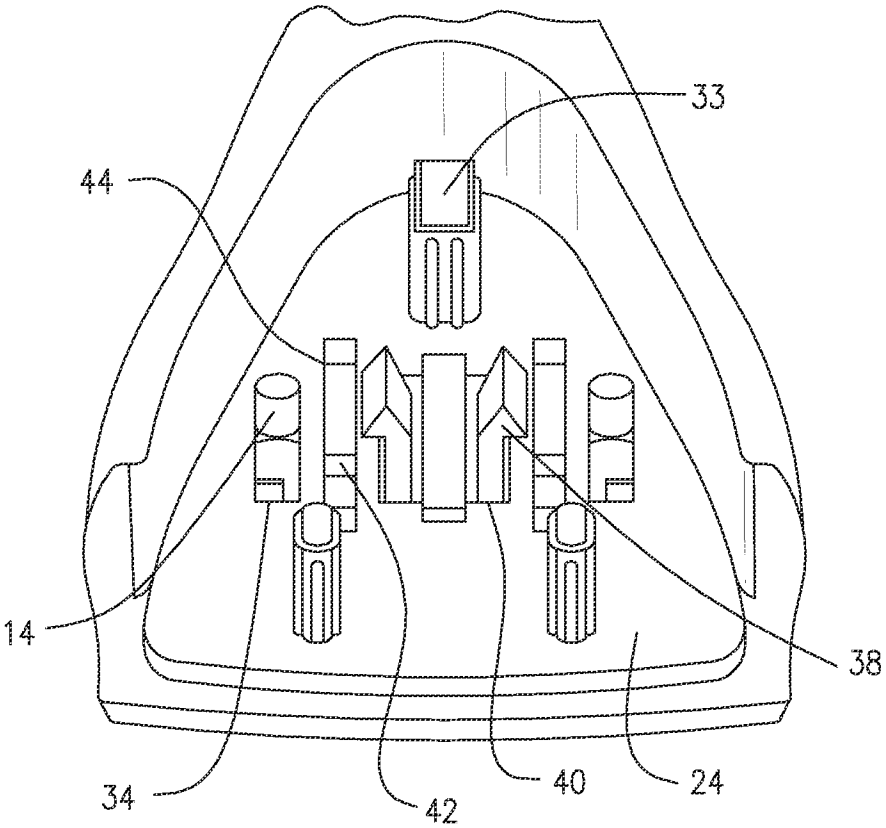
FIG. 3 is a plan view of a housing panel on which the activator is attached, with the activation element extending into the interior of the housing.
Figure 4:
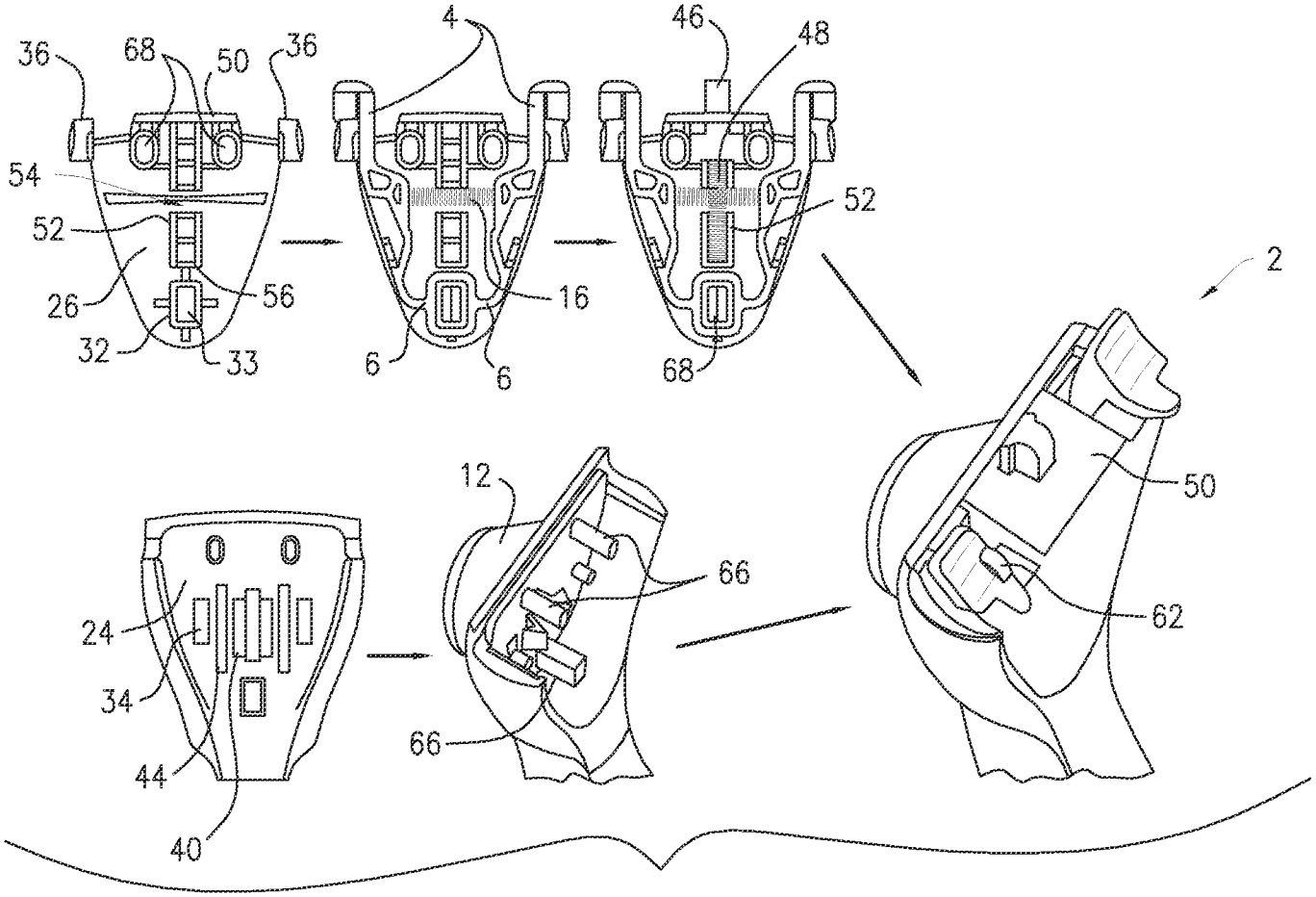
FIG. 4 is an exploded assembly view of a preferred arrangement and method of assembly of the connector according to the present invention.

In a preferred embodiment shown in FIGS. 1, 3 and 4, the fixed ends 6 of the arms 4 are fixed within the housing 22 on the interior of the cover housing panel 26 and the activator 12 is fixed on the exterior of the main housing panel 24.

The activator 12 is preferably attached to the cover housing panel 26 by snap-in barbed extensions 38 that pass thorough elongated catch apertures 40 and engage an interior surface of the cover housing panel 26. Guide bosses 42 on the bottom of the activator 12 fit within elongated guide apertures 44 to ensure that the activator 12 slides accurately on the housing 22, without twisting.

The activation element 14 of the activator 12 preferably comprises two posts passing through elongated activation apertures 34 in the main housing panel 24, and engage the arms 4 when the housing 22 is closed. It is noted that each of the catch apertures 40, guide apertures 44 and activation apertures 34 on the housing 22 are elongated, so that the activator 12 is movable from the capture position to the release position.

In this preferred embodiment, the fixed ends 6 of the arms 4 are fixed to the interior of the cover housing panel 26 by friction fit over a frame boss 32 with a center opening 33 on the cover housing panel 26. The biasing member 16 is preferably disposed perpendicular to the axis of the elongated handle 30 and fits on bosses on the second surfaces 20 of the arms 4 to ensure that the biasing member 16 maintains proper engagement with the arms 4 while moving between the capture position and the release position. Stop elements 36 are preferably included on the cover housing panel 24 to limit the outward travel of the outwardly biased arms 4.

The connector 2 is preferably used with a razor cartridge 28 that pivots in a direction P that is perpendicular to the elongated axis of the handle (see FIG. 2). In such an embodiment, the razor handle 30 includes a biasing element 45, preferably in the form of a spring loaded plunger comprising a plunger 46 with an associated spring 48 for biasing the razor cartridge 28 into a rest position, where the biasing element operates independently of the biasing member 16 of the connector 2.

In the preferred embodiment shown in FIGS. 1, 3 and 4, the plunger 46 and spring 48 are coupled to the cover housing panel 26 with the arms 4 and biasing member 16 of the connector. The leading end of the plunger 46 reciprocates through an opening in a faceplate 50 on the cover housing panel 24 to contact a cam surface 60 on the razor cartridge 28. The cover housing panel 24 preferably includes a channel 52 in which the spring 48 that biases the plunger 46 resides. As shown in FIGS. 1 and 4, the channel 52 preferably comprises a gap 54 across which the biasing member 16 passes and an end stop 56 against which the plunger spring 48 is held. In this way, the biasing member 16 acts independently of the biasing element 45.

Figure 5:
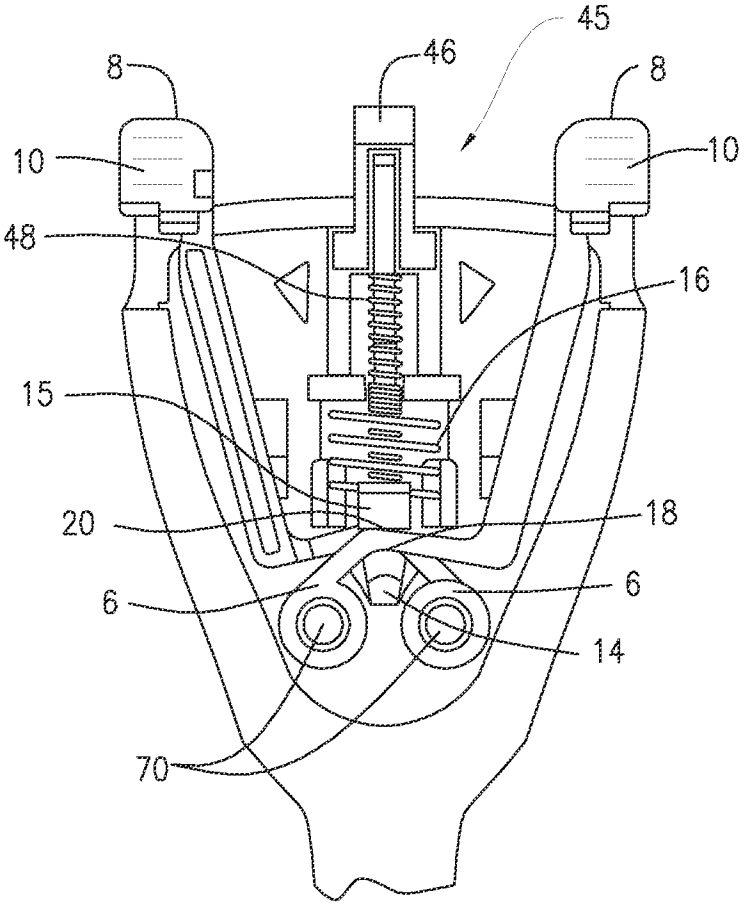
FIG. 5 is a plan view of an alternative razor cartridge connector according to the present invention, including a razor cartridge biasing element.

In an alternative embodiment shown in FIG. 5, the connector 2 comprises independent arms 4 with fixed ends 6 that are preferably fixed to separate arm bosses 70 on the interior of the housing 22. In this embodiment, the activation element 14 and a pusher 15 forming part of the biasing element 45 define a passage on a shared component of the activator 12, where the arms 4 pass through the passage. When the activator 12 is at rest, the pusher 15 of the biasing member 16 acts upon the second surface 20 of each arm 4 to bias the arms 4 outwardly into the capture position. When the activator 12 is activated, the activation element 14 is forced against the first surfaces 18 of each arm 4 to move the arms 4 into the release position.

In this alternative embodiment, the biasing member 16 is similarly a separate element from the biasing element 45, i.e., the biasing spring 48 that biases the plunger 46 illustrated is independent of the biasing member 16. Notwithstanding, the preferred alternative embodiment of FIG. 5 is shown with a biasing member 16 that is oriented along the axis of the elongated handle 30, where it fits around the spring 48 that biases the plunger 46 of the biasing element 45. Of course, as described above, other biasing means can be used for one or both of the biasing member and the biasing element.

Figure 6:
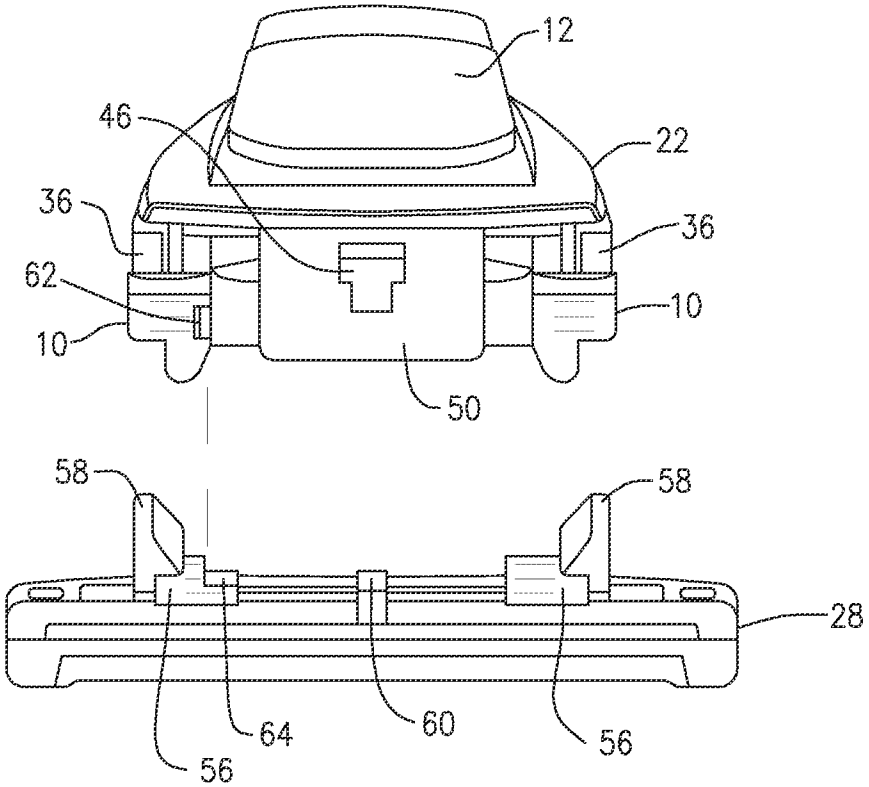
FIG. 6 is an exploded view of the razor connector and a razor cartridge.

The razor cartridge engagement members 10 on each of the terminal ends 8 of the arms 4 interact with cooperating structure on the razor cartridge 28 to securely hold the razor cartridge 28 on the handle 30. As best shown in FIGS. 2 and 6, the preferred cartridge engagement members 10 comprise outward arced extensions of a defined thickness that are received within an arced slot 56 within posts 58 mounted on the back of the razor cartridge 28, thereby allowing the razor cartridge 28 to pivot on the cartridge engagement members 10. To ensure that the razor cartridge 28 is properly oriented on the handle 30, the cartridge engagement member 10 on one arm 4 comprises a key 62 that mates with a keyway 64 on the razor cartridge 28 (see FIGS. 4 and 6). As such, the cartridge 28 can only fit on the connector 2 in a correct orientation.

When the cartridge engagement members 10 of the connector 2 engage the razor cartridge 28, the biasing member 16 forces the arms 4 outwardly to maintain the arms 4 in the capture position. Once the razor cartridge 28 is connected to the connector 2 on the handle 30, the biasing element 45 biases the razor cartridge 28 in its rest position. In the preferred embodiment shown in FIG. 2, the cam surface 60 on the razor cartridge 28 is acted upon by the biasing element 45 to bias the razor cartridge 28 in the rest position.

When the razor cartridge 28 is to be released, the activator 12 is deployed so that the activation element 14 pushes against the first surface 18 of each arm 4 to force the arms 4 inwardly into the release position. This disengages the cartridge engagement members 10 from the arced slots 56 of the razor cartridge 28 and allows the razor cartridge 28 to be removed from the connector 2. When the activator 12 is released, the biasing force on the second surface 20 of each arm 4 pushes against the activation element 14 to move the activator 12 back to the rest position, where the arms 4 are maintained in the capture position.

The preferred method of manufacturing a handle 30 with the preferred connector 2 of the present invention includes the steps of snap-fitting the activator 12 onto an exterior wall of a housing panel 24 or 26, so that the activator 12 is slidingly locked onto the exterior of the housing panel 24 or 26 with the activation element 14 passing through elongated openings 34 into the interior of the housing 22. The fixed ends 6 of the arms 4 are then fixed on a housing panel 24 or 26, which can be either the same or a different housing panel as that to which the activator 12 is fixed, with the terminal ends 8 of the arms 4 extending to the exterior of the housing 22. The biasing member 16 is placed between the arms 4 for biasing the arms 4 in a capture position. The plunger 46 and biasing element 48 of the biasing element 45 are then affixed to one of the housing panels 24 or 26 and the housing panels 24 and 26 are coupled to enclose the housing 22.

Notwithstanding the order of steps described above for manufacturing the connector 2 on a handle 30, it is understood that the steps do not need to be performed in any particular sequence.

In a preferred embodiment, the main housing panel 24 and the cover housing panel 26 are attached by cooperating attachment bosses 66 and attachment receivers 68 which are press fit to maintain the closed housing 22. In one embodiment, an attachment receiver 66 can be the center opening 33 of the frame boss 32 that fixes the unitary arms 4 (see FIG. 4). The housing panels 24 and 26 may then be attached, affixed or adhered, for example by sonic welding, mechanical fasteners or parts, adhesives or the like, including combinations thereof.

The arms 4 of the connector 2 can be formed of any suitable material, and are preferably made of an ABS plastic. In the preferred embodiment, the main housing panel is formed with the handle of a rigid material, and most preferably zinc, and the cover housing panel 26 is formed of an ABS plastic.

Variations, modifications and alterations to the preferred embodiment of the present invention described above will make themselves apparent to those skilled in the art. All such changes are intended to fall within the spirit and scope of the present invention, limited solely by the appended claims.

Any and all patents and/or patent applications referred to herein are hereby incorporated by reference.

The invention claimed is:

1. A razor cartridge connector comprising a. first and second arms, each arm comprising a fixed end, a terminal end, a first surface and a second surface opposed to the first surface, wherein the terminal end comprises a razor cartridge engagement member movable from a capture position for capturing a razor cartridge to a release position for releasing the razor cartridge;

b. an activator comprising an activation element associated with each of the first and second arms for moving the first and second arms toward each other into the release position when the activator is activated; and c. a biasing member for biasing the arms outwardly into the capture position, wherein the activation element acts upon the first and second arms between the fixed end and the terminal end on the first surface of the arms and the biasing member acts upon the arms between the fixed end and the terminal end on the second surface of the arms, wherein the same biasing member acting on the second surface of the first and second arms to bias the arms outwardly into the capture position also acts to bias the activation element acting on the first surface of the first and second arms to move the activator back to an activator rest position.

2. The razor cartridge connector of claim 1 wherein the first and second arms are formed as a unitary part with the fixed ends of the arms coupled.

3. The razor cartridge connector of claim 1 comprising a housing having an exterior and an interior, wherein the fixed ends of the arms and the biasing member are enclosed within the interior of the housing and the terminal ends of the arms extend to the exterior of the housing, with the razor cartridge engagement member on the exterior of the housing.

4. The razor cartridge connector of claim 3 wherein the housing comprises a plurality of housing panels.

5. The razor cartridge connector of claim 4 wherein at least one of the housing panels is an integral part of a razor handle and at least one of the housing panels is a cover.

6. The razor cartridge connector of claim 4, wherein the activator is slidingly affixed on an exterior surface of a first housing panel with the activation element extending into the interior of the housing.

7. The razor cartridge connector of claim 6, wherein the fixed ends of the arms are fixed to an interior surface of a second housing panel.

8. The razor cartridge connector of claim 7, wherein the second housing panel comprises a boss on which the fixed end of at least one arm is mounted.

9. The razor cartridge connector of claim 4, wherein at least one of the housing panels comprises a stop for limiting outward movement of the arms.

10. The razor cartridge connector of claim 4, wherein the plurality of housing panels are attached to form at least part of the housing.

11. The razor cartridge connector of claim 10, wherein the plurality of housing panels are attached by means taken from the group consisting of bosses and corresponding openings, sonic welding, an adhesive, a fastener, a snap, a latch, and combinations thereof.

12. The razor cartridge connector of claim 1, further comprising a biasing element for biasing the razor cartridge into a rest orientation.

13. The razor cartridge connector of claim 12 wherein the biasing element is distinct from the biasing member.

14. The razor cartridge connector of claim 13, wherein the biasing element comprises a spring loaded plunger that reciprocates within an opening on a housing panel on which the plunger is mounted.

15. The razor cartridge connector of claim 1, wherein the razor cartridge engagement member comprises an arced surface corresponding to a receiver for an arced surface on the razor cartridge for pivotal capture of the razor cartridge.

16. The razor cartridge connector of claim 1, wherein the razor cartridge engagement member on one of the first and second arms comprises at least one of a key and a keyway, corresponding to the other of a keyway and a key on the razor cartridge, for proper orientation of the razor cartridge on the connector.

17. The razor cartridge connector of claim 1, wherein the biasing member is oriented perpendicular to the elongated axis of the handle.

18. The razor cartridge connector of claim 1, wherein the arms further comprise a boss on the second surface that is engaged by the biasing member to maintain the biasing member in a proper position.

19. A razor handle comprising the connector of claim 1.

* * * * *